US008387166B2

(12) United States Patent
Eastep

(10) Patent No.: US 8,387,166 B2
(45) Date of Patent: Mar. 5, 2013

(54) CONVERTIBLE BAG AND VEST COMBINATION

(76) Inventor: Nancy Lynn Eastep, Oakland, CA (US)

( * ) Notice: Subject to any disclaimer, the term of this patent is extended or adjusted under 35 U.S.C. 154(b) by 387 days.

(21) Appl. No.: 12/371,542

(22) Filed: Feb. 13, 2009

(65) Prior Publication Data

US 2010/0205718 A1 Aug. 19, 2010

(51) Int. Cl.
*A41D 1/04* (2006.01)

(52) U.S. Cl. ..... 2/102; 2/462; 2/94; 2/95; 2/247; 224/153; 224/158; 224/160; 224/637; 224/638

(58) Field of Classification Search ..... 2/102, 913, 2/462, 89, 94, 114, 247, 248, 249, 250, 95; 224/153, 158, 160, 576, 637, 638, 639, 655
See application file for complete search history.

(56) References Cited

U.S. PATENT DOCUMENTS 1,778,057 A * 10/1930 Ballentine ..... 2/250
3,955,609 A 5/1976 Siegel
D269,561 S 7/1983 Scott
4,420,103 A * 12/1983 Douglass ..... 224/630
4,483,469 A 11/1984 Arisland
4,637,076 A 1/1987 Tartt et al.
4,669,127 A 6/1987 Swanson
4,901,897 A 2/1990 Briggs et al.
D316,172 S 4/1991 Hanson
5,014,359 A 5/1991 Hanson
5,022,092 A 6/1991 Bombrini
5,240,159 A * 8/1993 Gregory ..... 224/628
5,247,707 A 9/1993 Parker et al.
5,278,998 A 1/1994 Book
5,284,279 A * 2/1994 Sason et al. ..... 224/632
D352,165 S 11/1994 Covertson
5,634,579 A 6/1997 Baclawski
5,676,293 A * 10/1997 Farris ..... 224/576
5,797,529 A 8/1998 Lavine
5,829,060 A 11/1998 Falk et al.
5,845,336 A * 12/1998 Golde ..... 2/93
5,860,164 A 1/1999 Johnson
5,911,348 A 6/1999 Shook
5,987,644 A 11/1999 Mengato
D426,051 S 6/2000 Bugel et al.
D428,696 S 8/2000 Fier
6,108,816 A 8/2000 Bradley (Continued)

OTHER PUBLICATIONS

"Upland Vest Pack", www.llbean.com; Item No. TA56124; Nov. 20, 2008.

(Continued)

*Primary Examiner* — Alissa Tompkins
(74) *Attorney, Agent, or Firm* — Morgan, Lewis & Bockius LLP

(57) ABSTRACT

A combination of a vest and a versatile, adaptable bag allows a person to comfortably carry articles, even while physically active. The vest is contoured to the shape of a person's body, limiting the jostling of the vest and integrally attached bag as the person moves. One advantageous feature of the convertible bag is that its size can adapt to the desired contents: the upper portion of the bag acts either as a flap for the lower portion, or as a vertical extension of the lower portion when the bag contents are more voluminous. Further, the vest portion sits high on the chest of the person wearing the vest. This increases comfort to the person by distributing the weight better, and reduces sweating, particularly during physical activity such as riding a bicycle.

5 Claims, 8 Drawing Sheets

U.S. PATENT DOCUMENTS

| | | | | |
|---|---|---|---|---|
| 6,131,199 | A | 10/2000 | Bugel et al. | |
| 6,193,118 | B1 * | 2/2001 | Kearl | 224/153 |
| 6,315,178 | B1 | 11/2001 | Nobata | |
| 6,336,222 | B1 | 1/2002 | Ware | |
| 6,397,392 | B1 | 6/2002 | Wooley et al. | |
| 6,405,376 | B1 | 6/2002 | Falk et al. | |
| 6,405,377 | B1 | 6/2002 | Davis | |
| D464,197 | S | 10/2002 | Kegels | |
| 6,488,189 | B1 | 12/2002 | Smith | |
| 6,685,071 | B2 | 2/2004 | Prather | |
| D487,189 | S | 3/2004 | Ukitsu et al. | |
| 6,772,925 | B2 | 8/2004 | O'Hare | |
| D545,056 | S | 6/2007 | Leighton | |
| 2002/0139820 | A1 * | 10/2002 | Godshaw et al. | 224/153 |
| 2005/0194413 | A1 | 9/2005 | Baker | |
| 2007/0289199 | A1 * | 12/2007 | Looney | 43/54.1 |

OTHER PUBLICATIONS

"Pack Vest", www.patagonia.com; Style No. 48345; Nov. 20, 2008.

* cited by examiner

CONVERTIBLE BAG AND VEST COMBINATION

TECHNICAL FIELD

The disclosed embodiments relate generally to garments with packs capable of carrying articles, and more particularly to garments comprising a bag with an integrally attached vest.

BACKGROUND

One way for a person to carry articles is in a handbag or satchel, such as those disclosed in U.S. Pat. No. 3,955,609 and U.S. Pat. No. D464,197. One disadvantage of a handbag or satchel is that the hand holding the bag is fully occupied. This disadvantage is particularly pronounced when the user is engaged in an activity, such as riding a bicycle or hiking. In addition, if the articles in the handbag or satchel are heavy, the bag places a significant strain on the user's hand and arm.

Another way for a person to carry articles is in a backpack, such as the one disclosed in U.S. Pat. No. 4,420,103. A backpack does not occupy the hands of a user, and does not strain the user's hand or arm. However, a typical backpack design places significant strain on the two shoulder straps. In addition, a bulky fix-sized backpack creates a center of gravity away from a user's back. To compensate, a user will frequently have to lean forward in an awkward posture. Further, even with two shoulder straps and a belt strap, a backpack is typically unstable, with articles jostling around as the user moves.

There have been some proposals to combine a pack and a garment. See, for example, U.S. Pat. No. 5,247,707, U.S. Pat. No. 5,278,998, and U.S. Pat. No. 5,987,644. These designs, however, have several drawbacks. First, the garments typically cover the entire torso, which is undesirable for a user engaged in active movement such as bicycling. In addition, the designs have fixed-size pack area, which is either not as useful because it is small, or awkward because it is large.

An object of the present invention is to provide a garment with both a bag and a vest that overcomes the foregoing disadvantages and drawbacks.

SUMMARY

According to one embodiment, a garment comprises a bag portion and a vest portion. The back panel of the vest integrates with the back panel of the bag, and the vest portion can be worn by a person. The bag has a lower portion and an upper portion, and the lower portion of the bag is the part that integrates with the vest. When the upper portion of the bag is empty, the upper portion forms a flap that folds over the lower portion. When the contents of the bag exceed the capacity of the lower portion of the bag, the upper portion extends the compartment formed by the lower portion of the bag, extending upward from the lower portion. When the upper portion is thus extended, there is a single compartment formed by the lower and upper portions. The ability of the upper portion to function as a flap or as an extension of the bag is one way in which embodiments of the invention are adaptable to various loads that may be carried in the bag.

In some embodiments the vest is configured so that it covers only the upper portion of the wearer's chest. In some embodiments, the lowest portion of the vest in the middle of the wearer's chest is above the wearer's sternum. The vest distributes the weight broadly so that the wearer is able to bear a heavy load more comfortably. The vest may comprise two sides that are fastened together in front with snaps. In some embodiments there are two or more sets of snaps to accommodate various thicknesses of clothing.

In some embodiments the bag has zippered gussets along at least a portion of the side panels. The zippers may be one-way or two-way. When the zippered gussets are fully zipped up, the horizontal depth of the bag is smaller, keeping the articles in the bag closer to the wearer's back. This provides a better center of gravity for the bag, and reduces jostling of articles in the bag as the wearer moves. When the zippers are fully open, the gussets expand the compartment to the largest horizontal depth, allowing the compartment to hold more or larger articles. In some embodiments the zippers extend from the center top of the upper portion of the bag down the side panels to the lower portion of the bag. In some embodiments the zippers extend only part of the way down the side panels of the lower portion of the bag. Zippered gussets are another way of making embodiments of the invention adaptable to various loads that may be carried in the bag.

In some embodiments portions of the vest are padded. Padding in general increases the wearer's comfort while bearing the weight of the bag and its contents. Padding on the back panel of the vest reduces the likelihood that articles in the bag will poke, prod, injure, or otherwise irritate the back of the wearer. The padding can comprise many different materials, including flannel, felt, batting, or polyester fill.

In some embodiments, portions of the vest or bag are composed of waxed cotton. Waxed cotton is a natural fiber that feels particularly comfortable against the skin of the wearer. In addition, waxed cotton helps to repel water, making the garment more suitable for wet weather.

In some embodiments, the front of the bag has a pocket and a strap that are suitable for holding a U-shaped lock. Many embodiments are well-suited for bicycle riders, and many bicycle riders use U-shaped locks for their bicycles. The pocket and strap provide a convenient place to hold a U-shaped lock while a bicyclist is riding. In some embodiments the pocket is below the strap, and the strap is permanently attached to the bag at both ends. In some embodiments the "U" portion of the U-shaped lock is "upside-down," with the rounded portion of the "U" at the top. The middle of the strap attaches to the bag, effectively providing two straps that hold the long bars of the U-shaped lock. In some embodiments the middle of the strap attaches to the bag with a hook and loop fastener. For example, Velcro® is one such brand of fastener. An alternative means of connecting the middle of the strap to the bag is a snap fastener. In some alternative embodiments, the middle of the strap is permanently attached to the bag, and the outer ends of the strap detachably connect to the bag.

To make some embodiments, a sequence of manufacturing steps is preferred. In particular, the vest and "bag" portions of some embodiments are integrated together before the "bag" is a complete bag. After the vest and back panel of the "bag" are attached together, the remainder of the bag is constructed. In some cases, attaching the vest to the back portion of the bag simplifies the manufacturing process; it would be more difficult to attach the vest to the bag after the bag was fully constructed. The order of manufacturing operations may differ from one embodiment to another.

In some embodiments the vest is contoured to fit the body of the wearer. This stabilizes the bag, and thus it does not move much, even when the wearer is active. In some embodiments, the vest has a lower arc or curved portion that snugly fits a person's body. This lower curved portion of the vest is not attached directly to the back panel of the bag, acting primarily to stabilize the vest and bag by wrapping around the wearer's lower back and upper chest.

In some embodiments there are pockets on the front part of the vest. These front pockets allow the wearer to access small items without taking the garment off. In some embodiments the front pockets are pleated to allow for great capacity.

In some embodiments there are one or more side pockets on the side panels of the bag. The side pockets may be zippered, elasticized, or closed using a snap or hook and loop fasteners.

In some embodiments the bottom of the bag comprises leather, or is lined with leather. The bottom of the bag must support the weight of the articles in the bag, and may be poked or prodded with sharp points, so a sturdy material for the bottom is advantageous. Many other sturdy materials may be used for the bottom of the bag, including Kevlar®.

In some embodiments there is a handle attached to the vest or bag portion to allow the garment to be carried by hand. In some embodiments such handles are padded.

Embodiments of the present application are generally configured so that the bag does not interfere with sitting or riding a bicycle. To accommodate riding, the bag portion of an embodiment is positioned high enough on the vest so that the bag would not reach the bicycle seat upon which a user is sitting. Similarly, the bag portion would not reach a chair (or other object) upon which a user is seated.

BRIEF DESCRIPTION OF THE DRAWINGS

Like reference numerals refer to corresponding parts throughout the drawings.

DESCRIPTION OF EMBODIMENTS

Figure 1:
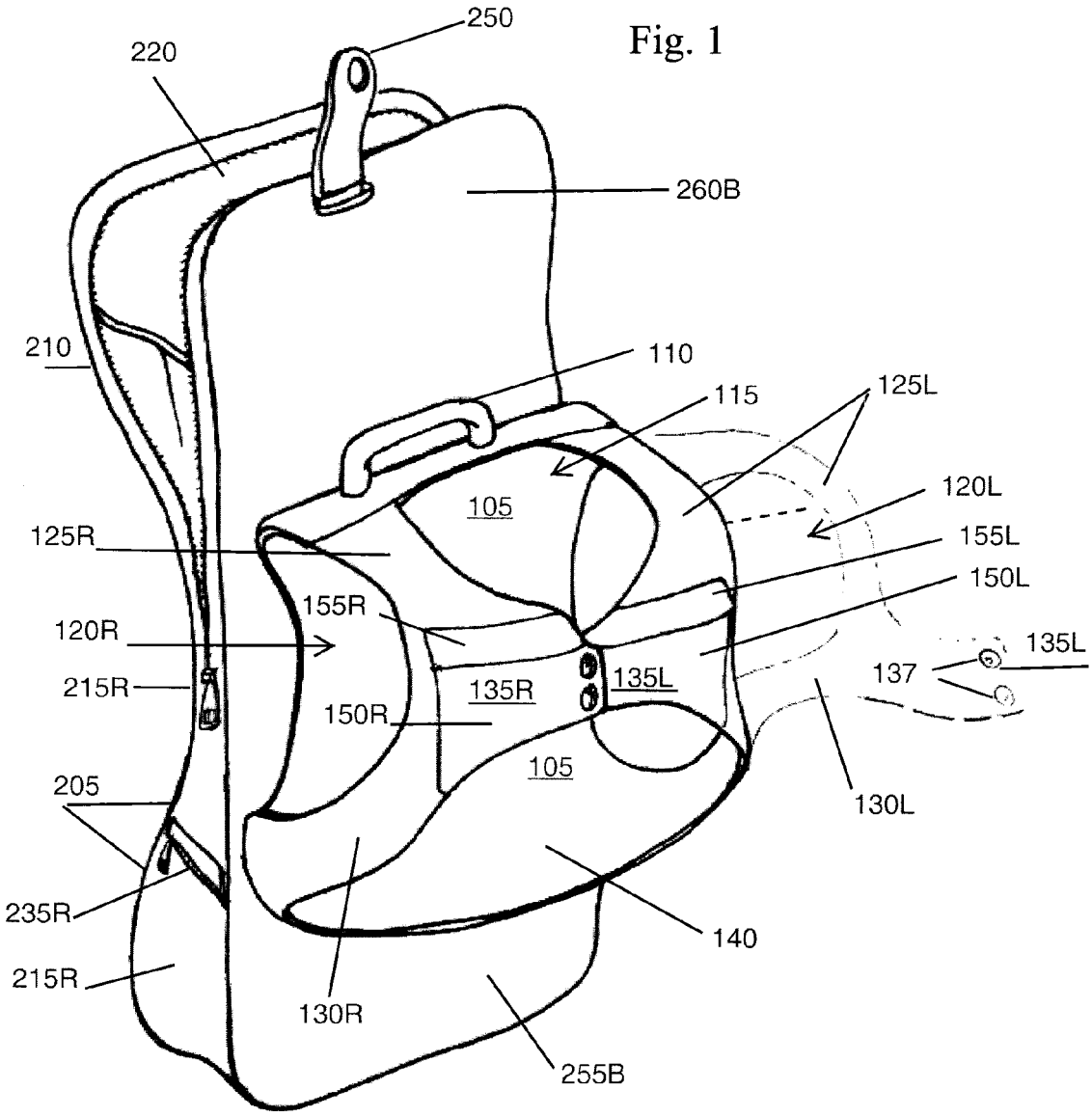
FIG. 1 illustrates an embodiment of a garment having a vest and a bag, with the bag shown fully extended upward.

FIG. 1 illustrates one embodiment of a garment having both a vest and a bag. The vest and bag portions may comprise any suitably sturdy material, such as tightly woven natural or petroleum based fiber poplin, canvas, rip-stop, or the like. Padded portions would typically comprise flannel, felt, batting, or polyester fill. In a preferred embodiment, portions of the bag and vest comprise waxed cotton.

The vest portion in the embodiment of FIG. 1 has back panel 105 that is integrally attached to the lower back panel 255B of the bag. The upper right vest strap 125R and lower right vest strap 130R may comprise one or more pieces of material. Together with back panel 105, vest straps 125R and 130R form right arm opening 120R. The left side of the vest has similar vest straps 125L and 130L, and together with back panel 105 form left arm opening 120L.

FIG. 1 also shows front vest panels 135R and 135L that attach together in the middle of the vest. In this embodiment the left and right front vest panels attach to each other with one or more sets of snaps 137. Although not shown in FIG. 1, there can be two or more sets or snaps so that front vest panels 135R and 135L can fit appropriately regardless of the wearer's underlying clothing. Together with back panel 105, upper vest straps 125R and 125L and front vest panels 135R and 135L form head opening 115.

The embodiment in FIG. 1 also shows front pockets 150R and 150L, with pocket flaps 155R and 155L. Pocket flaps 155R and 155L protect the pocket contents from water and other weather conditions, and also reduce the likelihood that the contents of the pockets will spill or fly off when the wearer is engaged in physical activity. In some embodiments, pocket flaps 155R and 155L attach to the top of the pockets 150R and 150L with hook and loop fasteners or snap fasteners.

Figure 4:
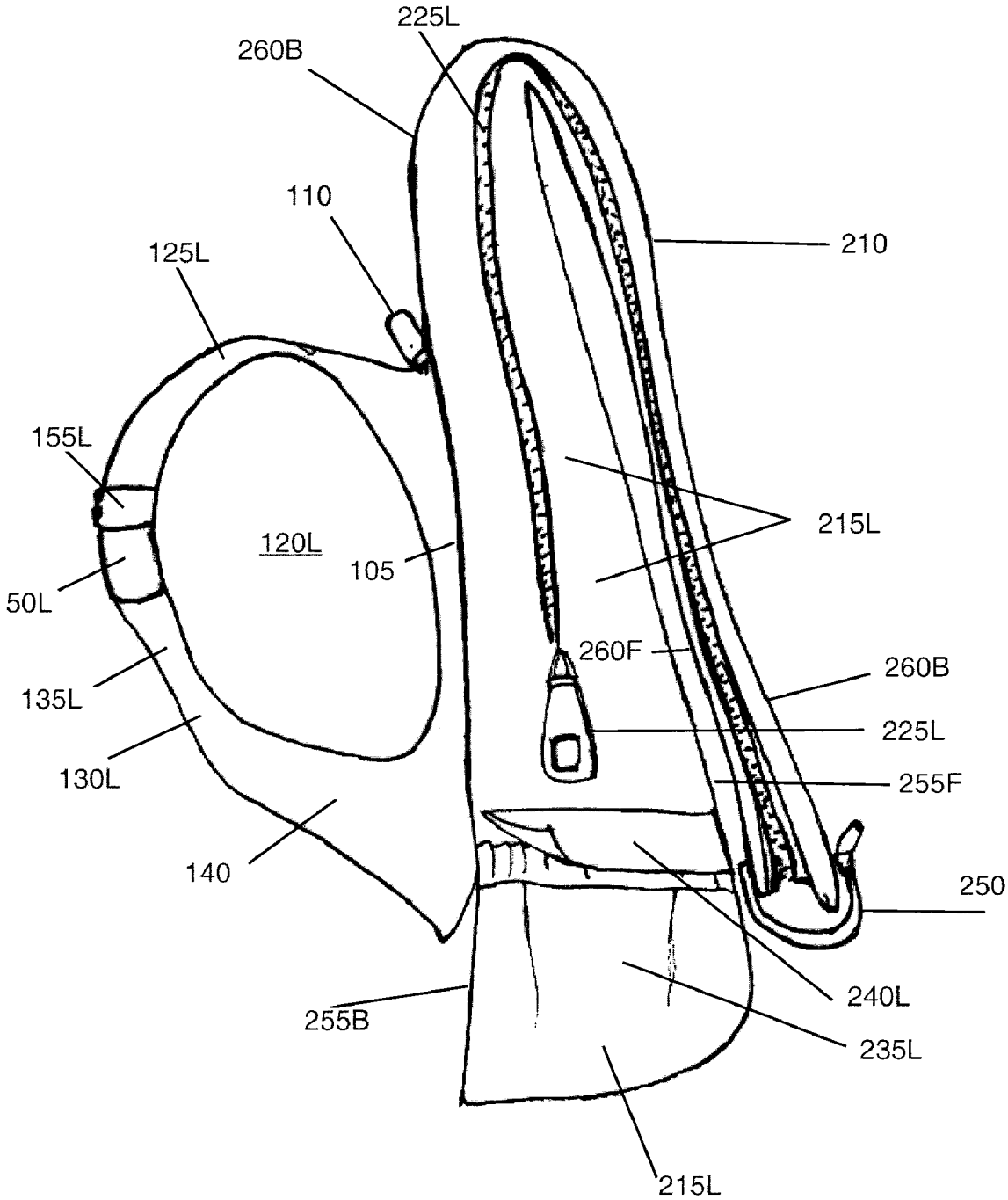
FIG. 4 is a side view of an embodiment of a garment having a vest and a bag, showing an exemplary side pocket and a zippered gusset, with the upper portion folded over to form a flap.

The embodiment in FIG. 1 also shows a carrying handle 110. The carrying handle 110 is optionally padded, and allows a user to carry the convertible bag and vest combination by hand. When carried this way, the upper portion 210 of the bag is typically folded over the bottom portion 205, as shown in FIGS. 2 and 4.

Figure 5:
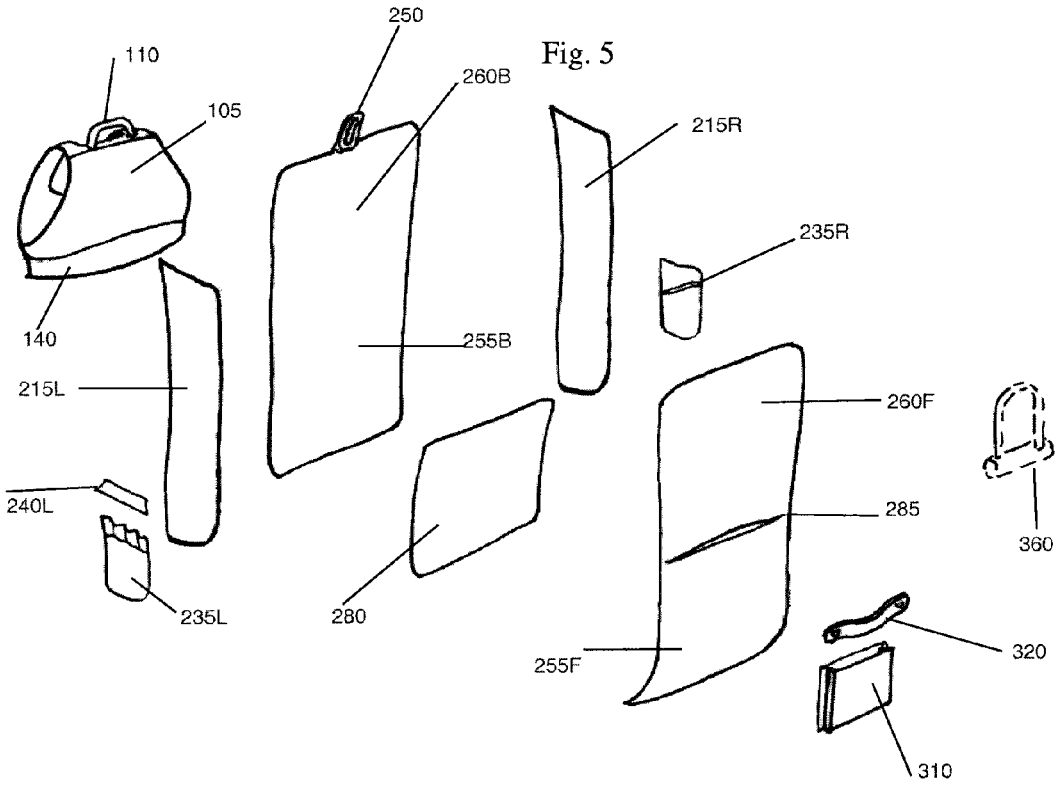
FIG. 5 shows a vest and an exploded view of an embodiment of a bag. This exploded view does not show the individual components of the vest portion.

As further shown in FIG. 1, the embodiment has a bag, which comprises an upper portion 210 and a lower portion 205. As shown in FIG. 1, the bag has a right side 215R, and a top 220. (The left side of the bag is shown in FIG. 4.) The back side of the bag has an upper back panel 260B and a lower back panel 255B. As noted above, the lower back panel 255B of the back is integrally attached to the back panel 105 of the vest. The front of the bag is shown in FIGS. 3 and 5, and described below.

The embodiment in FIG. 1 also shows closure strap 250 attached to the upper back panel 260B of the bag. The closure strap 250 may have a snap or other connector means, which can detachably connect to the front of the bag (see FIG. 5 and description below).

Figure 2:
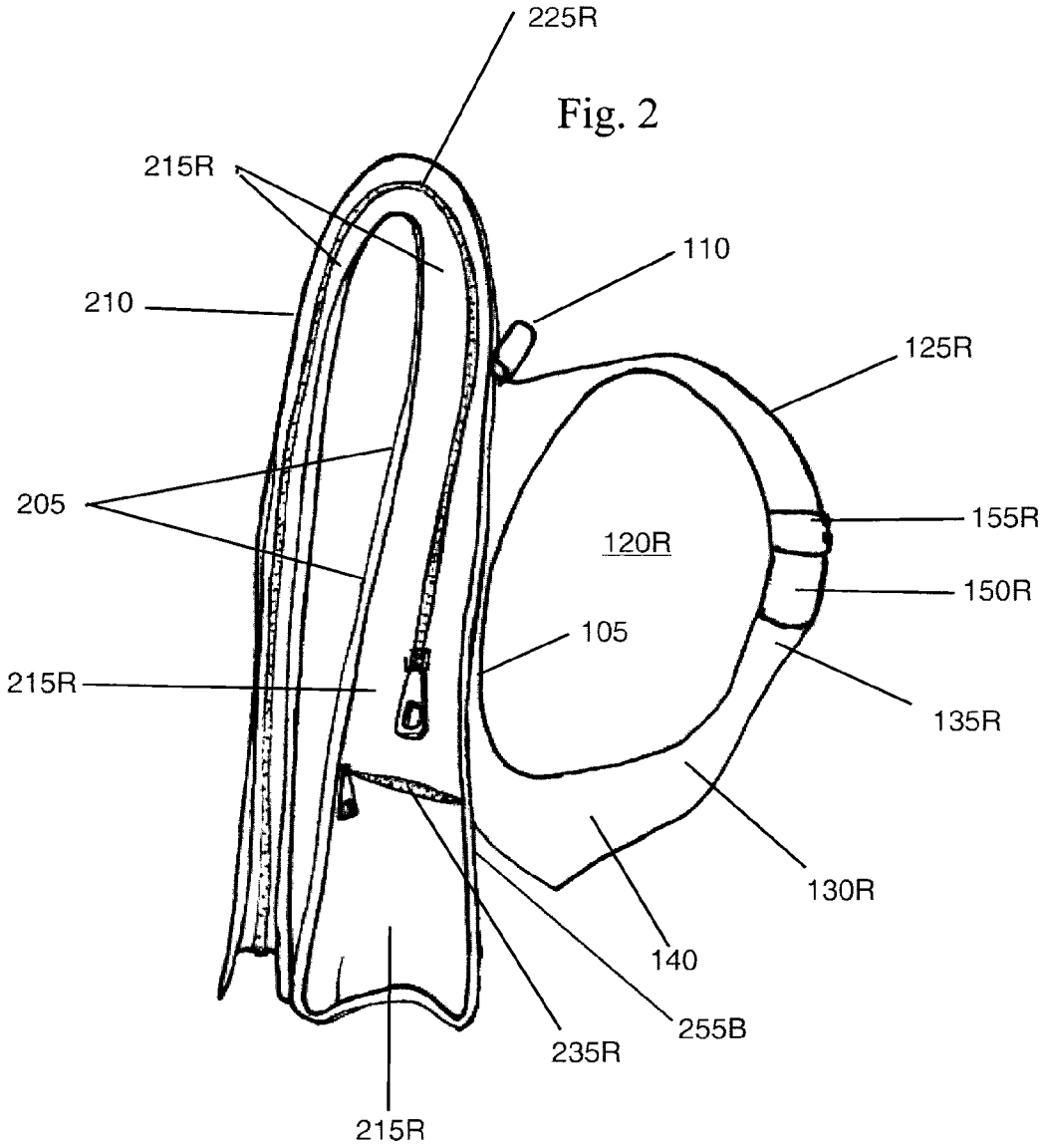
FIG. 2 is a side view of an embodiment in which the upper portion is folded over to form a flap.
Figure 3:
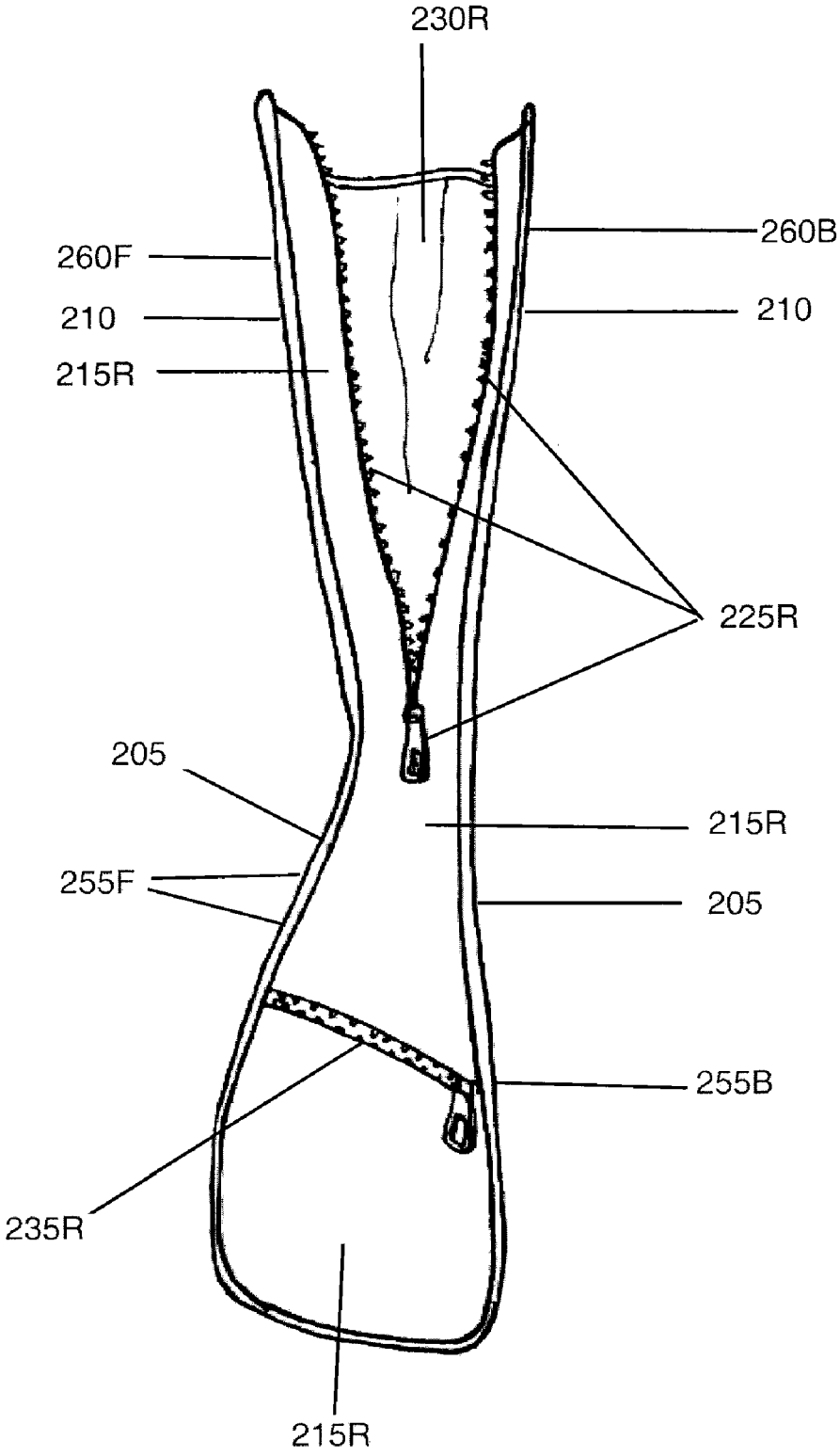
FIG. 3 is a side view of the bag portion, showing an exemplary side pocket and a zippered gusset, with the upper portion fully extended upward.

The embodiment in FIG. 1 has right side pocket 235R, which is more fully depicted and described in reference to FIGS. 2 and 3. The embodiment in FIG. 1 also shows lower vest body arc 140, which is more fully depicted and described in reference to FIG. 7.

FIG. 2 is a side view of an embodiment similar to the one in FIG. 1. In this view, upper and lower right vest straps 125R and 130R are visible, and together with vest back panel 105, form right arm opening 120R. The right front vest panel 135R is located where the upper right vest strap 125R meets the lower right vest strap 130R. As shown in FIG. 2, the right front vest panel may have a right pocket 150R with right pocket flap 155R. These are described above with respect to FIG. 1. The left side of the vest (which is not visible in FIG. 2) is generally symmetric to the visible right side of the vest, and described more fully below with reference to FIG. 4. Lower vest body arc 140 wraps around from the vest back panel 105 to the lower right vest strap 130R and right front vest panel 135R. The lower vest body arc 140 is more fully shown and described in references to FIG. 7. FIG. 2 also shows carrying handle 110, which may be attached to the vest, the bag, or both.

The embodiment in FIG. 2 shows the upper portion 210 of the bag folded over the lower portion 205 of the bag. As shown, lower back panel 255B of lower bag portion 205 is attached to the back panel 105 of the vest. The side view in FIG. 2 shows the right side 215R of the bag, which extends all the way from the bottom to the top. FIG. 2 also shows right side pocket 235R. Right side pocket 235R may be zippered. FIG. 2 also shows right gusset zipper 225R, which extends from the upper portion 210 of the bag down into the lower portion 205 of the bag. As shown, a gusset zipper typically does not extend all the way to the bottom of the lower portion 205 of the bag.

FIG. 3 provides a more detailed side view of the bag portion of an embodiment. A complete embodiment would show the back panel 105 of the vest attached to lower back panel 255B of the bag. FIG. 3 shows the right side view of an embodiment with the bag fully extended upwards. In this orientation, the upper portion 210 of the bag is above the lower portion 205 of the bag. The front of the bag comprises upper front panel 260F and lower front panel 255F. The right side 215R of the bag has zippered right pocket 235R and right side gusset zipper 225R. The back of the bag comprises upper back panel 260B and lower back panel 255B.

FIG. 4 shows the left side view of an embodiment with the top portion 210 of the bag folded over as a flap. In this view, upper and lower left vest straps 125L and 130L are visible, and together with vest back panel 105, form left arm opening 120L. The left front vest panel 135L is located where the upper left vest strap 125L meets the lower left vest strap 130L. As shown in FIG. 4, the left front vest panel may have a left pocket 150L with left pocket flap 155L. These are described above with respect to FIG. 1. Lower vest body arc 140 wraps around from the vest back panel 105 to the lower left vest strap 130L and left front vest panel 135L. The lower vest body arc 140 is more fully shown and described in reference to FIG. 7. FIG. 4 also shows carrying handle 110, which may be attached to the vest, the bag, or both. The back panel 105 of the vest is attached to lower back panel 255B of the bag, which is below upper back panel 260B of the bag.

When the upper portion 210 of the bag is extended vertically as in FIG. 3, upper front panel 260F is above lower front panel 255F. However, when the upper portion 210 is folded over as in FIG. 4, upper front panel 260F falls next to lower front panel 255F. FIG. 4 shows an optional closure strap 250, which is permanently attached to the top of upper back panel 260B. In FIG. 4, closure strap 250 is detachably connected to upper front panel 260F, looping across the top of the bag. A user may also detachably connect the closure strap 250 to lower front panel 255F, which would prevent the upper portion of the bag from flapping around.

The embodiments in FIGS. 3 and 4 show side pockets. The right side pocket 235R in FIG. 3 is an exemplary zippered pocket. The left side pocket 235L in FIG. 4 is an exemplary pocket that is covered with a left side pocket flap 240L. The top of left side pocket flap 240L is permanently attached to the left side 215L of the bag, and a portion of left side pocket flap 240L may detachably connect to the left side 215L of the bag or the left side pocket 235L using hook and loop fasteners or snap fasteners. Left side pocket flap 240L operates similar to pocket flaps 155R and 155L described above with reference to FIG. 1. One of skill in the art would recognize that zippered pockets or pockets with flaps could be used on either side of the bag, and that each side of the bag could have zero or more such pockets.

The embodiments in FIGS. 3 and 4 show zippered gussets. The right side gusset zipper 225R is shown zipped open, and the left side gusset zipper 225L is shown zipped closed. Right and left side gusset zippers 225R and 225L may be one way or preferably two-way. FIG. 3 shows that when the right side gusset zipper 225R is open, it exposes an upper inner right side wall 230R of the bag. Thus, even with the gusset fully or partially opened, the upper inner right side wall 230R holds articles inside the bag. The upper inner right side wall 230R extends only to the top of the bag, and not over the top of the bag. In this embodiment, the right side gusset zipper 225R functions as an ordinary zipper along the top to open the top of the bag. The left side gusset zipper 225L shown in FIG. 4 functions in the same way as right side gusset zipper 225R. One of skill in the art would recognize that other configurations of zippers are possible that fall within the teachings provided herein. For example, the gusset zippers along the sides could be distinct from the zipper or zippers that open the top of the bag.

FIG. 5 shows a vest and an exploded view of a bag that attaches to the vest. This view shows carrying handle 110 attached to the top of vest back panel 105. Lower vest body arc 140 is connected to the bottom of the vest back panel 105. The lower vest body arc 140 wraps around the body of a person and stabilizes the vest and bag. The back panel of the bag comprises lower back panel 255B and upper back panel 260B. Attached at the top of the back panel is closure strap 250. In some embodiments, lower back panel 255B is attached to vest back panel 105 before the back panel of the back is attached to the other pieces of the bag.

Attached to the upper and lower back panels 255B and 260B are left and right side panels 215L and 215R. The left and right side panels 215L and 215R may incorporate one or more pockets. The exploded view of FIG. 5 shows a zippered pocket 235R that will attach to the right side panel 215R and a left pocket 235L with a left side pocket flap 240L. The bag optionally includes an internal pocket or sleeve 280 that attaches to lower back panel 255B. The internal pocket 280 may be used to hold a laptop computer or any other articles.

The exploded view in FIG. 5 shows the front panel of the bag comprising lower front panel 255F and upper front panel 260F. Roughly in the middle is a horizontal zippered opening 285. This horizontal zippered opening allows access to the interior of the bag without requiring a user to open the bag at the top. In particular, the zippered opening is generally near the height of internal pocket 280, so a user can access the contents of the internal pocket 280 easily.

As shown in FIG. 5, lower front panel 255F may have a lock pocket 310 and lock holding strap 320. The lock pocket 310 and lock holding strap 320 are suitable for holding a U-shaped lock, as more full described in reference to FIG. 8. The locking portion 360 of a U-shaped lock fits into the lock pocket 310.

The closure strap 250 shown in FIG. 5 may detachably connect either to the upper front panel 260F (when the bag is extended upwards as shown in FIGS. 1 and 3) or to the lower front panel 255F (when the upper portion of the bag is folded over as shown in FIGS. 2 and 4).

Figure 6:
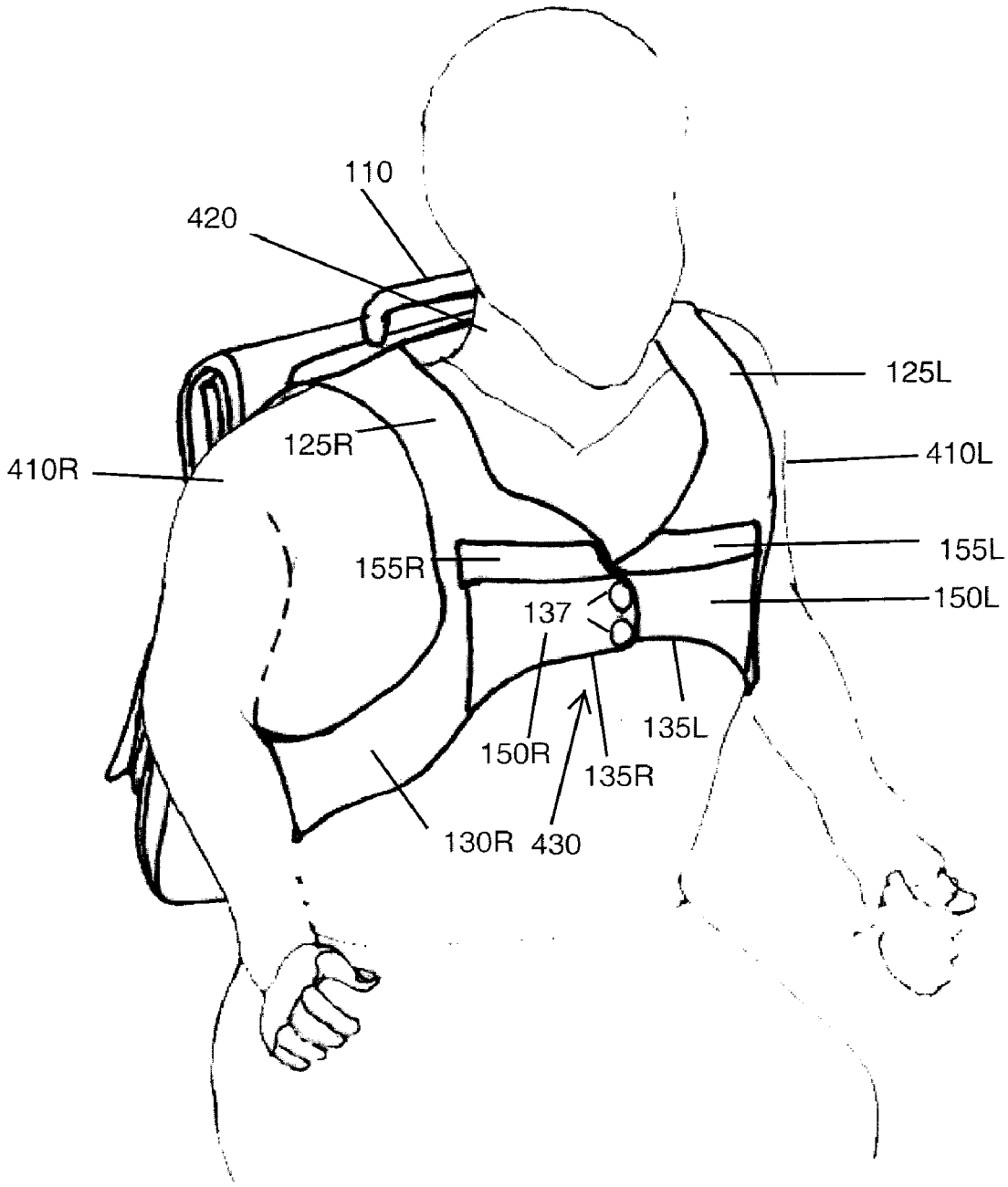
FIG. 6 illustrates how the garment is worn by a person.

FIG. 6 shows how an embodiment of the garment may be worn by a person. As shown in FIG. 1, vest back panel 105 together with right vest straps 125R and 130R forming right arm opening 120R. In FIG. 6, the person's right arm 410R is sticking through right arm opening 120R, making right arm opening 120R not visible in the figure. Similarly, vest back panel 105 (shown in FIG. 1) together with left vest straps 125L and 130L (shown in FIGS. 1 and 4) form left arm opening 120L. In FIG. 6, the person's left arm 410L protrudes through left arm opening 120L, making left arm opening 120L not visible in the figure. As shown in FIG. 1, vest back panel 105, together with upper vest straps 125R and 125L and vest front panels 135R and 135L form head opening 115. In FIG. 6 the person's neck 420 is protruding through the head opening 115, making the head opening 115 not visible.

As seen in FIG. 6, the left and right front vest panels 135R and 135L attach together high on the chest of the person wearing the vest. The person's sternum 430 is below the bottom of the vest in this embodiment.

The embodiment of a garment shown in FIG. 6 also shows that front pockets 150R and 150L (together with pocket flaps 155R and 155L) are located high on the chest of the person wearing the vest. The right front pocket 150R and right pocket flap 155R are located on the right front vest panel 135R. Similarly, left front pocket 150L and left pocket flap 155L are located on the left front vest panel 135L. The right and front vest panels are held together with snaps 137. Although FIG. 6 shows only one set of two snaps, alternative embodiments may have two or more sets of snaps, or a set of snaps could comprise three or more snaps 137 aligned in some pattern. In FIG. 6, the snaps 137 are aligned vertically.

When the vest is worn by a person, carrying handle 110 is located behind the neck 420 of that person.

Figure 7:
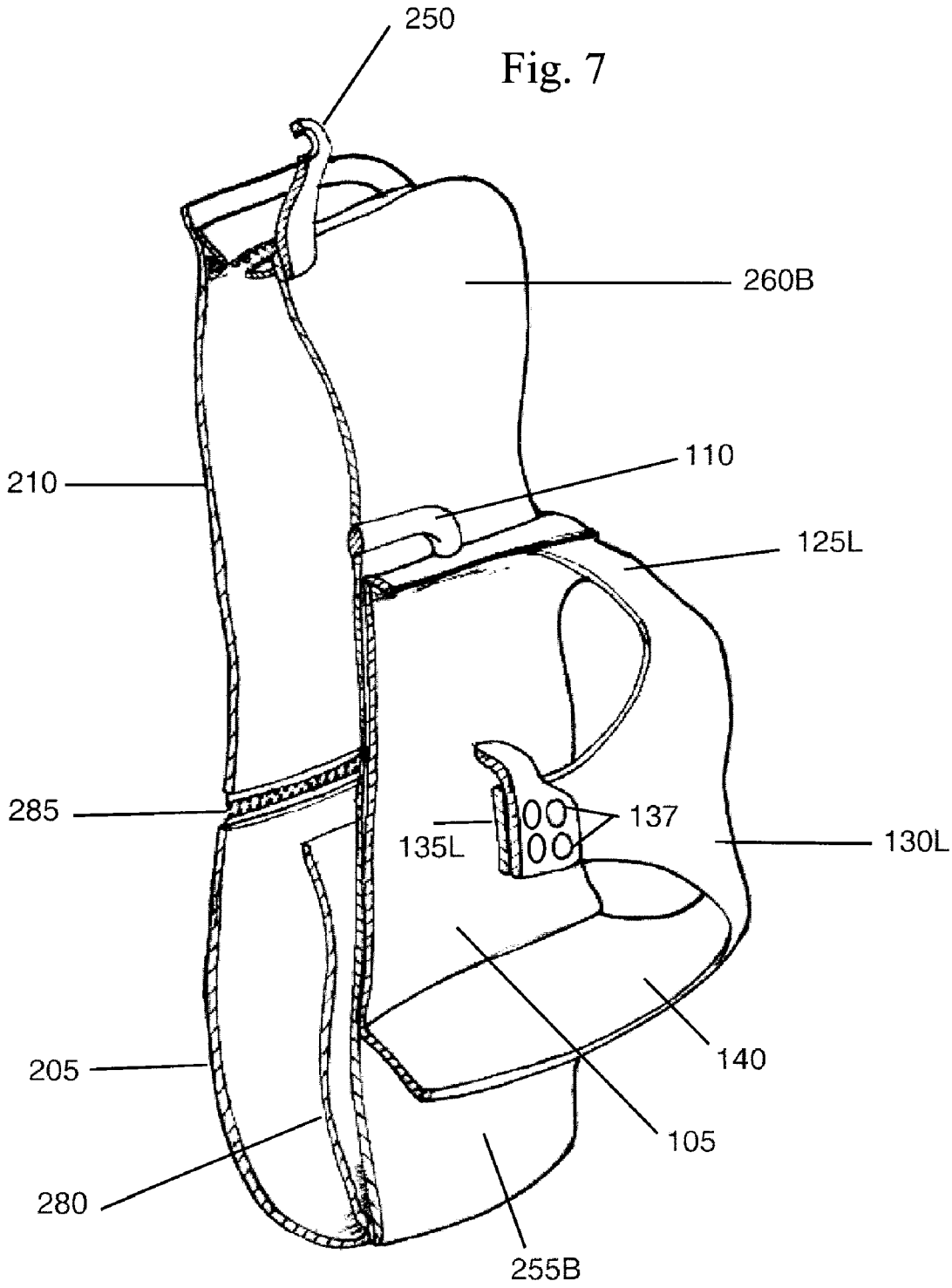
FIG. 7 is a cross-sectional view of an embodiment. The embodiment is similar to the one in FIG. 1, but cut away to show only the left half.

FIG. 7 is a cutaway view showing the left half of an embodiment of the invention. This embodiment is similar to the embodiment in FIG. 1, but the view allows some additional features to be visible. The embodiment in FIG. 7 shows two sets of snaps 137 at the end of left vest front panel 135L. Here, a set of snaps is a vertical pair, and there are two such sets shown. The two sets of snaps 137 allow a user to adjust the tightness of the vest, typically based on the thickness of the user's underlying clothing.

FIG. 7 also shows lower vest body arc 140. Lower vest body arc 140 is curved to fit the contour of a person, which stabilizes the bag even during active physical activity. In addition, the fitted contour is more comfortable for the wearer than the straps of backpacks.

The cutaway view in FIG. 7 shows an embodiment with an internal pocket or pouch 280. This internal pocket 280 can be useful to segregate items inside the bag, or keep all of the items near the back of the wearer when there are few items in the bag. In the latter case, by keeping items in the pocket the center of gravity is kept closer to the wearer's back, resulting in less strain on the wearer. The view in FIG. 7 also shows zippered opening 285. The zippered opening 285 allows a user to access the contents of the bag or internal pocket 280 without opening the top of the bag. In this embodiment, even if gusset zippers 225R and 225L are fully zipped closed, zippered opening 285 allows a user access to the contents of the bag.

Figure 8:
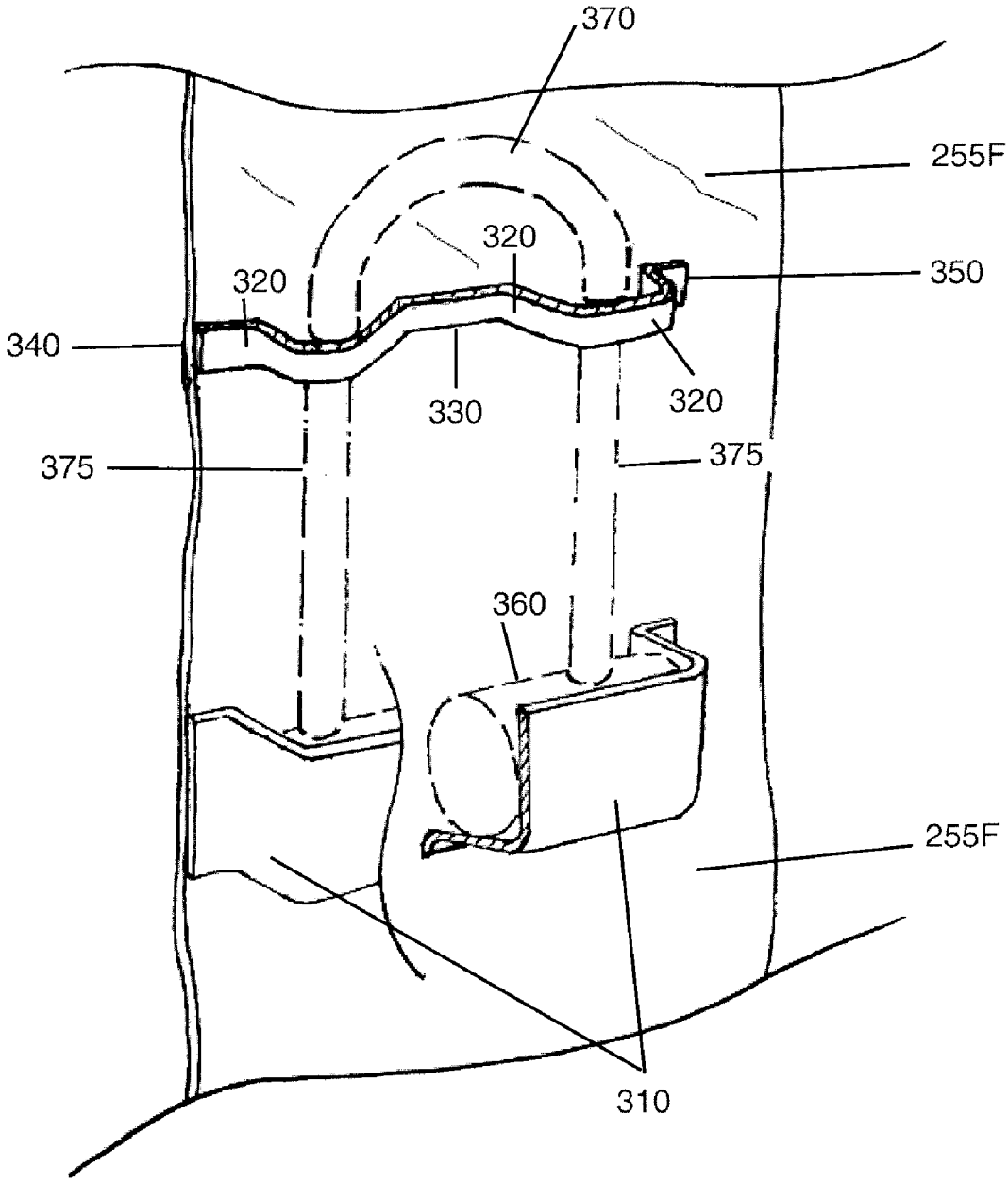
FIG. 8 is a close-up drawing of a pocket and strap that can hold a U-shaped lock.

FIG. 8 shows a lock pocket 310 and lock holding strap 320 that are used in some embodiments to hold a U-shaped lock. The lock pocket 310 is secured to the lower front panel 255F (see FIGS. 3 and 5) of the bag. Lock pocket 310 is typically secured on both the bottom and both sides. Lock pocket 310 is large enough to hold the locking portion 360 of a U-shaped lock. Lock holding strap 320 is typically above the lock pocket 310, and configured to form two loops. In one embodiment, the left strap end 340 and right strap end 350 are permanently attached to the lower front panel 255F of the bag. In this configuration, the middle 330 of the strap is detachably connected to the lower front panel 255F of the bag. The detachable connection at the middle 330 may use hook and loop fasteners, snaps, or the like. In an alternative embodiment, the middle 330 is permanently attached to the lower front panel 255F, and the left and right strap ends 340 and 350 are detachably connected to the lower front panel 255F. The detachable connections may use hook and loop fasteners, snaps, or the like. One of ordinary skill in the art would recognize that other configurations are possible that fall within the scope of the teaching herein, such as using two independent straps rather than a single contiguous strap. When the middle 330 and ends 340 and 350 of the strap are attached to the lower front panel 255F, there are two loops formed that hold the long bars 375 of a U-shaped lock. The U-shaped portion 370 of a U-shaped lock is the highest part of a U-shaped lock when held by lock holding strap 320 and lock pocket 310. One of ordinary skill in the art would also recognize that lock pocket 310 and lock holding strap 360 could hold locks that are not "U-shaped." Although many bicycle locks are currently U-shaped as described here and shown in FIG. 8, a U-shape is not required. For example, any lock with a locking portion 360 and one or two long bars 375 could be held by the lock pocket 310 and lock holding strap 320.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the invention and its practical applications, to thereby enable others skilled in the art to best utilize the invention and various embodiments with various modifications as are suited to the particular use contemplated.

What is claimed is:

1. A garment, comprising:

a vest having a back panel that is integrated with a back panel of a bag;

the bag including a lower portion that integrates with the vest and an upper portion separate from the vest;

the lower portion of the bag forming a compartment with a first capacity;

the upper portion of the bag configured to fold over onto the lower portion of the bag when contents of the compartment do not exceed the first capacity; and the upper portion of the bag configured to expand the compartment vertically when contents of the compartment exceed the first capacity, the expanded compartment having a second capacity greater than the first capacity;

wherein the vest includes a left flap with a left arm opening, and a right flap with a right arm opening, the left flap and right flap configured to detachably connect across a top portion of a person's chest, when the garment is worn by the person, so as to form a front panel of the vest.

2. The garment of claim 1, wherein the bag further includes side panels adjacent to the back panel of the bag, each side panel including a vertical zippered gusset, and wherein the compartment is configured to expand horizontally when the vertical zippered gussets are unzipped, thereby increasing capacity of the compartment.

3. The garment of claim 2, wherein the bag further includes a top side, and wherein the zippered gussets comprise a pair of two-way zippers, each two-way zipper extending along at least a portion of one the side panel of the bag and along at least a portion of the top side of the bag.

4. A garment, comprising:

a vest having a back panel that is integrated with a back panel of a bag;

the bag including a lower portion that integrates with the vest and an upper portion separate from the vest;

the lower portion of the bag forming a compartment with a first capacity;

the upper portion of the bag configured to fold over onto the lower portion of the bag when contents of the compartment do not exceed the first capacity; and the upper portion of the bag configured to expand the compartment vertically when contents of the compartment exceed the first capacity, the expanded compartment having a second capacity greater than the first capacity;

wherein the bag has a front panel that includes a pocket and a strap configured to hold a U-shaped lock, wherein the strap: has two ends, is located above the pocket, is permanently attached to the bag at both ends of the strap, and includes a middle portion having a means to detachably connect to the bag.

5. The garment of claim 1 wherein the bag has a front panel that includes a horizontal zippered opening providing direct access to the compartment, and the horizontal zippered opening is distinct from an opening at the top of the bag.

* * * * *

UNITED STATES PATENT AND TRADEMARK OFFICE

CERTIFICATE OF CORRECTION

PATENT NO. : 8,387,166 B2
APPLICATION NO. : 12/371542
DATED : March 5, 2013
INVENTOR(S) : Nancy Lynn Eastep It is certified that error appears in the above-identified patent and that said Letters Patent is hereby corrected as shown below:

In the Claims:

At column 8, line 51, between the words “one” and “side”, please delete “the”.

Signed and Sealed this
Twenty-third Day of April, 2013

Teresa Stanek Rea
*Acting Director of the United States Patent and Trademark Office*